US010018376B2

(12) United States Patent
Sato et al.

(10) Patent No.: US 10,018,376 B2
(45) Date of Patent: Jul. 10, 2018

(54) COMBUSTION TYPE WATER HEATER

(71) Applicant: RINNAI CORPORATION, Nagoya-shi, Aichi (JP)

(72) Inventors: Eri Sato, Nagoya (JP); Makoto Kito, Nagoya (JP)

(73) Assignee: RINNAI CORPORATION, Nagoya-Shi, Aichi (JP)

( * ) Notice: Subject to any disclaimer, the term of this patent is extended or adjusted under 35 U.S.C. 154(b) by 52 days.

(21) Appl. No.: 15/427,731

(22) Filed: Feb. 8, 2017

(65) Prior Publication Data

US 2017/0234578 A1 Aug. 17, 2017

(30) Foreign Application Priority Data

Feb. 12, 2016 (JP) ..... 2016-024965

(51) Int. Cl.
*F24H 9/20* (2006.01)
*F24H 1/14* (2006.01)

(52) U.S. Cl.
CPC ..... *F24H 9/2035* (2013.01); *F24H 1/145* (2013.01)

(58) Field of Classification Search
CPC ..... F24H 9/2035; F24H 1/145
See application file for complete search history.

(56) References Cited

U.S. PATENT DOCUMENTS 5,950,573 A * 9/1999 Shellenberger ..... F23D 14/82 122/18.31
6,401,708 B1 6/2002 Kim et al.
2013/0025546 A1 1/2013 Okamoto
(Continued)

FOREIGN PATENT DOCUMENTS

JP H7-146263 6/1995
JP H7-208810 8/1995
JP H08278022 A 10/1996
JP 2002168446 A * 6/2002
JP 2008-138952 6/2008
JP 2010249438 A * 11/2010
JP 2013-029254 2/2013
JP 2013-160488 8/2013

OTHER PUBLICATIONS

Machine translation prepared by the Japanese Patent Office and English Translation of Abstract of Japanese Patent Application No. JPH7-146263.
(Continued)

*Primary Examiner* — Nathaniel Herzfeld
(74) *Attorney, Agent, or Firm* — Vierra Magen Marcus LLP

(57) ABSTRACT

The present description discloses a combustion type water heater that heats water by burning fuel. The combustion type water heater includes: a burner that generates combustion gas by burning the fuel; a heat exchanger that exchanges heat between the water passing through on an inside of the heat exchanger and the combustion gas flowing on an outside of the heat exchanger, an exhaust pipe that discharges the combustion gas after the heat exchange in the heat exchanger as exhaust gas; an exhaust gas temperature detector that detects a temperature of the exhaust gas flowing in the exhaust pipe as an exhaust gas temperature; a clog degree detector that detects a degree of clog in the exhaust pipe; and a scale buildup determiner that determines whether or not scale has built up inside the heat exchanger based on the exhaust gas temperature and the degree of clog in the exhaust pipe.

7 Claims, 3 Drawing Sheets

(56) References Cited

U.S. PATENT DOCUMENTS

| | | | | |
|---|---|---|---|---|
| 2014/0060458 | A1* | 3/2014 | Fujimoto | F24H 9/2035 122/14.3 |
| 2015/0096504 | A1 | 4/2015 | Ando | |
| 2015/0144074 | A1 | 5/2015 | Fujimoto et al. | |

OTHER PUBLICATIONS

Machine translation prepared by the Japanese Patent Office and English Translation of Abstract of Japanese Patent Application No. JPH7-208810.

Machine translation prepared by the Japanese Patent Office and English Translation of Abstract of Japanese Patent Application No. JP2008-138952.

Machine translation prepared by the Japanese Patent Office and English Translation of Abstract of Japanese Patent Application No. JP2013-029254.

Machine translation prepared by the Japanese Patent Office and English Translation of Abstract of Japanese Patent Application No. JP2013-160488.

European Search Report dated Jun. 28, 2017, in European Patent Appl. No. 171554405.5.

* cited by examiner

COMBUSTION TYPE WATER HEATER

TECHNICAL FIELD

The technique disclosed herein relates to a combustion type water heater.

BACKGROUND ART

Japanese Patent Application Publication No. H7-146263 discloses a combustion type water heater that heats water by burning fuel. This combustion type water heater is provided with a burner that generates combustion gas by burning fuel, a heat exchanger that exchanges heat between the water passing through inside thereof and combustion gas flowing outside thereof, and a fouling sensor that detects whether or not scale is built up inside the heat exchanger. According to this combustion type water heater, the fouling sensor detects scale buildup inside the heat exchanger and treatment for descaling can be performed.

SUMMARY

In the technique of Japanese Patent Application Publication No. H7-146263, a dedicated fouling sensor for detecting the scale buildup inside the heat exchanger needs to be provided, which gives rise to increase in product size and manufacturing cost. A technique that allows the detection of the scale buildup inside the heat exchanger without providing a dedicated sensor such as the fouling sensor is being demanded.

The disclosure herein provides a combustion type water heater that heats water by burning fuel. This combustion type water heater comprises a burner configured to generate combustion gas by burning the fuel; a heat exchanger configured to exchange heat between the water passing through on an inside of the heat exchanger and the combustion gas flowing on an outside of the heat exchanger, an exhaust pipe configured to discharge the combustion gas after the heat exchange in the heat exchanger as exhaust gas; an exhaust gas temperature detector configured to detect a temperature of the exhaust gas flowing in the exhaust pipe as an exhaust gas temperature; a clog degree detector configured to detect a degree of clog in the exhaust pipe; and a scale buildup determiner configured to determine whether or not scale has built up inside the heat exchanger based on the exhaust gas temperature and the degree of clog in the exhaust pipe.

When the scale builds up inside the heat exchanger, heat transmissivity of the heat exchanger drops, which results in an increase in the exhaust gas temperature. Due to this, in the above combustion type water heater, the determination is made on whether or not the scale has built up inside the heat exchanger based on the exhaust gas temperature. Notably, the exhaust gas temperature rises not only when the scale has built up inside the heat exchanger, but also by progression of clogging in the exhaust pipe. Due to this, in the case of performing the scale buildup determination based on the exhaust gas temperature, an influence in the rise of the exhaust gas temperature that accompanies the progression of the clogging in the exhaust pipe needs to be removed. To do so, the above combustion type water heater determines whether or not the scale has built up inside the heat exchanger based on the exhaust gas temperature and the degree of clog in the exhaust pipe. As to the detection of the degree of clog in the exhaust pipe, various detection methods using sensor or the like with which a combustion type water heater would normally be provided without using a dedicated sensor have conventionally been known. According to the above combustion type water heater, the scale buildup inside the heat exchanger can be detected without using a dedicated sensor such as a fouling sensor.

In the above combustion type water heater, the scale buildup determiner may be configured to determine that scale has built up inside the heat exchanger when the exhaust gas temperature exceeds an upper limit exhaust gas temperature, and the upper limit exhaust gas temperature may be set lower for a case where the degree of clog in the exhaust pipe is high than for a case where the degree of clog in the exhaust pipe is low.

According to the above combustion type water heater, the determination on whether or not the scale has built up inside the heat exchanger can be performed accurately while avoiding an influence of a rise in the exhaust gas temperature that accompanies progression of the clog of the exhaust pipe.

In the above combustion type water heater, the upper limit exhaust gas temperature may be set according to a combustion amount of the burner.

When the combustion amount of the burner changes, the exhaust gas temperature changes according thereto. In the above combustion type water heater, the determination on whether or not the scale has built up inside the heat exchanger can be performed more accurately by setting the upper limit exhaust gas temperature according to the combustion amount of the burner.

The above combustion type water heater may further comprise a memory configured to store determination result history of the scale buildup determine, and the upper limit exhaust gas temperature may be set lower for a case where the scale buildup inside the heat exchanger had previously been detected than for a case where the scale buildup inside the heat exchanger has never been detected.

Quality of water supplied to the combustion type water heater differs depending on a region where the combustion type water heater is used. If the combustion type water heater is to be used in a region where water with which the scale easily builds up is supplied, it is preferable to promptly detect the scale buildup and promptly perform descaling. According to the above combustion type water heater, when the scale buildup had previously been detected in the past, the upper limit exhaust gas temperature is set low in the scale buildup determination that takes place thereafter so that the scale buildup becomes more prone to being detected. By configuring as above, the scale buildup can promptly be detected and the descaling can promptly be performed for cases where the combustion type water heater is to be used in the region where water with which the scale easily builds up is supplied.

The above combustion type water heater may further comprise an air supply pipe configured to supply air to the burner, a fan configured to send the air from the air supply pipe to the burner and send the exhaust gas to the exhaust pipe; and a current detector configured to detect driving current of the fan. The clog degree detector may be configured to detect the degree of clog of the exhaust pipe based on the driving current of the fan.

If the degree of clog in the exhaust pipe is high, the fan is more likely to run idle as compared to a case where the degree of clog in the exhaust pipe is low, which results in reduction of driving current of the fan. Thus, in the above combustion type water heater, the degree of clog in the exhaust pipe is detected based on the driving current of the fan. The degree of clog in the exhaust pipe can be detected using a sensor with which a combustion type water heater would normally be provided, without using a dedicated sensor.

Alternatively, the above combustion type water heater may further comprise a high temperature thermocouple arranged in a vicinity of the burner. The burner may be an all-primary air burner, and the clog degree detector may detect the degree of clog in the exhaust pipe based on a detection signal of the high temperature thermocouple.

If the burner is an all-primary air burner, flame of the burner becomes shorter when the degree of clog in the exhaust pipe is high as compared to when the degree of clog in the exhaust pipe is low, and the detection signal of the high temperature thermocouple arranged in a vicinity of the burner increases. Thus, in the above combustion type water heater, the degree of clog in the exhaust pipe is detected based on the detection signal of the high temperature thermocouple. The degree of clog in the exhaust pipe can be detected using a sensor with which a combustion type water heater would normally be provided, without using a dedicated sensor.

Alternatively, the above combustion type water heater may further comprise a combustion flame thermistor arranged apart from a burner port of the burner by a predetermined distance. The burner may be a Bunsen burner, and the clog degree detector may be configured to detect the degree of clog in the exhaust pipe based on a detection signal of the combustion flame thermistor.

If the burner is a Bunsen burner, the flame of the burner becomes longer when the degree of clog in the exhaust pipe is high as compared to when the degree of clog in the exhaust pipe is low, and the detection signal of the combustion flame thermistor arranged apart from the burner port of the burner by a predetermined distance increases. Thus, in the above combustion type water heater, the degree of clog in the exhaust pipe is detected based on the detection signal of the combustion flame thermistor. The degree of clog in the exhaust pipe can be detected using a sensor with which a combustion type water heater would normally be provided, without using a dedicated sensor.

DETAILED DESCRIPTION

Figure 1:
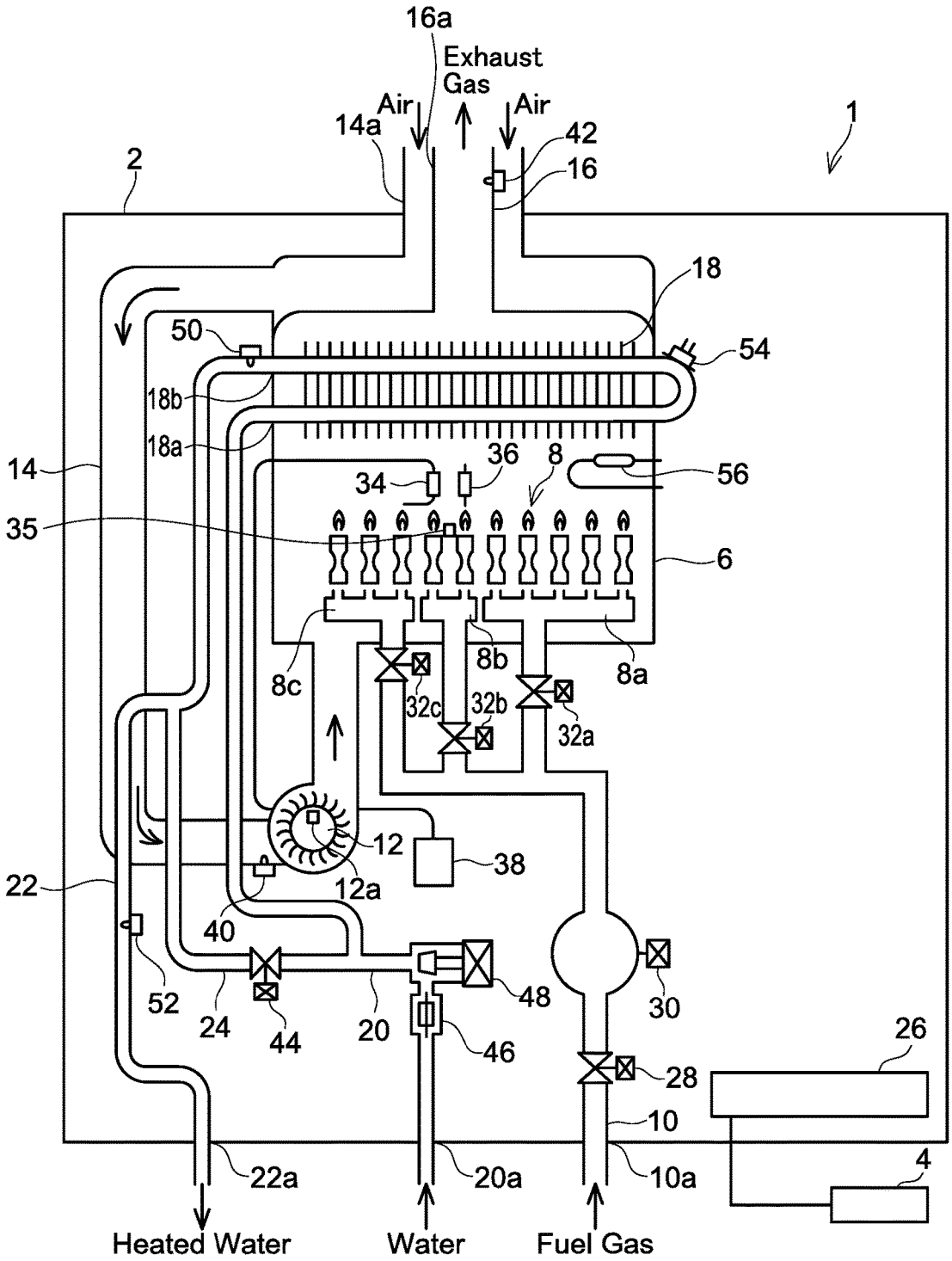
FIG. 1 is a diagram schematically showing a configuration of a water heater 1 of an embodiment.

As shown in FIG. 1, a water heater 1 of an embodiment of a combustion type water heater comprises a water heater body 2, and a remote controller 4 for remotely controlling the water heater body 2. The water heater body 2 primarily includes a combustion chamber 6, a burner 8, a fuel gas supply pipe 10, a fan 12, an air supply pipe 14, an exhaust pipe 16, a heat exchanger 18, a water input pipe 20, a heated water output pipe 22, a bypass pipe 24, and a controller 26.

The burner 8 and the heat exchanger 18 are arranged inside the combustion chamber 6. The heat exchanger 18 is arranged above the burner 8. The burner 8 of the present embodiment is an all-primary air burner. In another embodiment, the burner 8 may be a Bunsen burner. The burner 8 is composed of three combustion sections with different combustion amounts (namely a first combustion section 8*a*, a second combustion section 8*b*, and a third combustion section 8*c*), and plural levels of combustion amount ranges can be set according to combinations of these combustion sections. The burner 8 is supplied with fuel gas from the fuel gas supply pipe 10. The burner 8 burns the fuel gas supplied from the fuel gas supply pipe 10 to generate combustion gas. The combustion gas heats water by heat exchange that takes place with the water passing through on the inside of the heat exchanger 18 when the combustion gas flowing on an outside of the heat exchanger 18.

Figure 2:
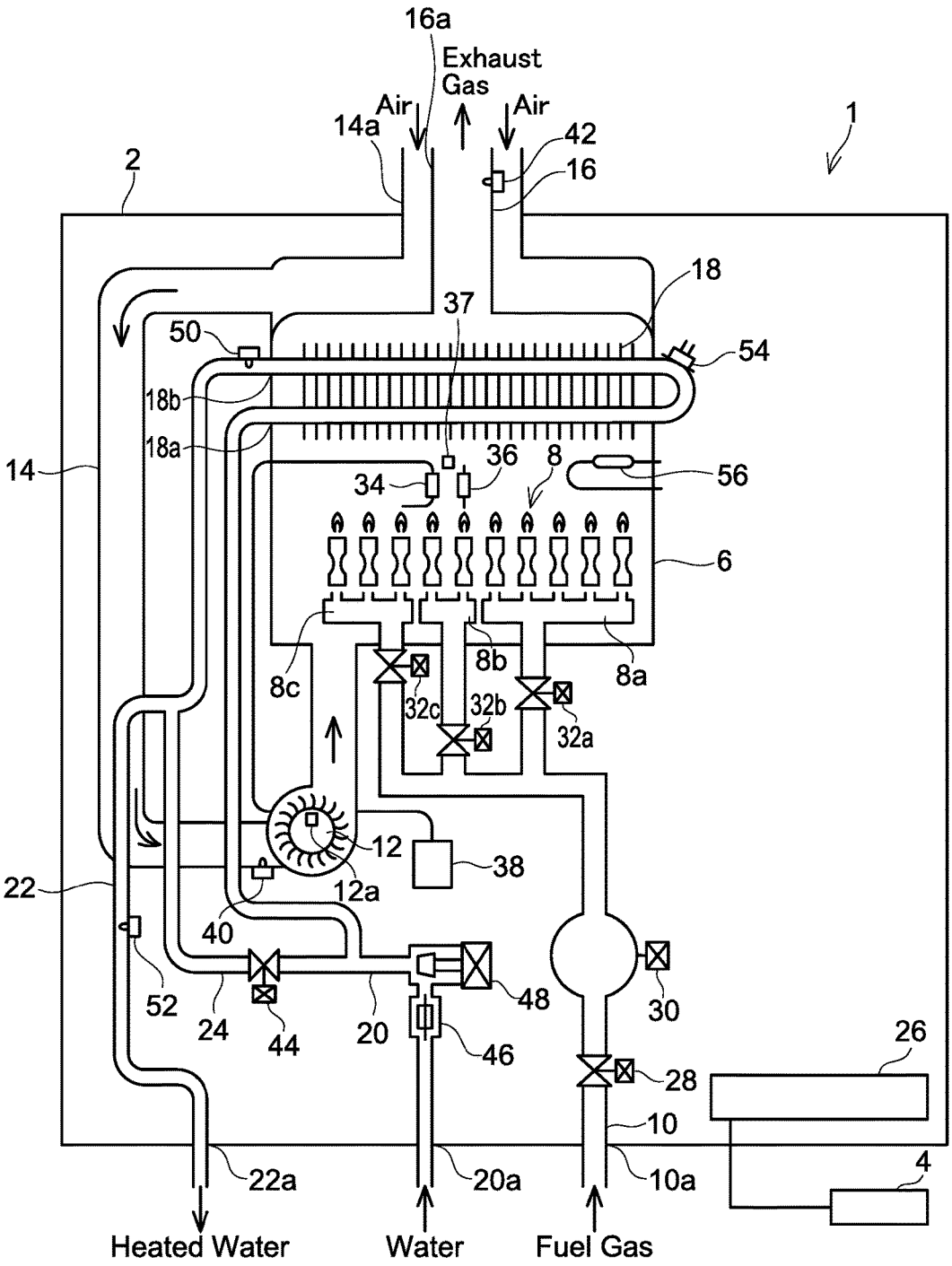
FIG. 2 is a diagram schematically showing a configuration of a water heater 1 of a variant.

A fuel gas supply inlet 10*a* communicated with a fuel gas supply source (not shown) is provided at an upstream-side end of the fuel gas supply pipe 10. The fuel gas supply pipe 10 is provided with a gas source solenoid valve 28, a gas proportional valve 30, and gas switching solenoid valves 32*a*, 32*b*, 32*c* in this order from an upstream side. When one or more of the gas switching solenoid valves 32*a*, 32*b*, 32*c* are opened in a state where the gas source solenoid valve 28 is open, the fuel gas is supplied to corresponding one or more of the first combustion section 8*a*, the second combustion section 8*b*, and the third combustion section 8*c*. An ignition plug 34 for ignition of the burner 8, a flame rod 36 for detecting combustion flame of the burner 8, and a high temperature thermocouple 35 for detecting a temperature of the burner 8 are provided in a vicinity of the burner 8. The ignition plug 34 is connected to the ignitor 38. The flame rod 36 is arranged in a vicinity of burner ports of the burner 8. The high temperature thermocouple 35 is arranged in a vicinity of the burner 8. Notably, if the burner 8 is the Bunsen burner, as shown in FIG. 2, a combustion flame thermistor 37 for detecting a temperature of the combustion flame of the burner 8 may be provided instead of the high temperature thermocouple 35. In this case, the combustion flame thermistor 37 is arranged apart from the burner ports of the burner 8 by a predetermined distance.

Air for combustion in the burner 8 is supplied into the combustion chamber 6 through the air supply pipe 14. An air supply inlet 14*a* for taking the air in from outside the water heater body 2 is provided at an upstream-side end of the air supply pipe 14. The fan 12 intakes the air into the air supply pipe 14 through the air supply inlet 14*a* and sends the air in the air supply pipe 14 toward an inside of the combustion chamber 6. An air supply temperature sensor 40 for detecting a temperature of the air sent to the combustion chamber 6 is provided in the air supply pipe 14 in a vicinity of the fan 12. Further, the fan 12 is provided with a current sensor 12*a* for detecting driving current of the fan 12.

In the combustion chamber 6, the combustion gas after having heat exchanged with the heat exchanger 18 is sent out to the exhaust pipe 16 as exhaust gas. An exhaust gas outlet 16*a* for discharging the exhaust gas to the outside of the water heater body 2 is provided at a downstream-side end of the exhaust pipe 16. An exhaust gas temperature sensor 42 for detecting a temperature of the exhaust gas discharged to the outside of the water heater body 2 through the exhaust gas outlet 16*a* is provided in the exhaust pipe 16 in a vicinity of the exhaust gas outlet 16*a*.

The air supply pipe 14 and the exhaust pipe 16 have a double pipe structure in the vicinity of the air supply inlet 14*a* of the air supply pipe 14 and in the vicinity of the exhaust gas outlet 16*a* of the exhaust pipe 16, and the exhaust pipe 16 is housed within the air supply pipe 14. Due to this, heat exchange takes place between the air flowing into the air supply pipe 14 through the air supply inlet 14*a* and the exhaust gas discharged from the exhaust pipe 16 through the exhaust gas outlet 16*a*. Due to this, the exhaust gas to be discharged to the outside of the water heater body 2 through the exhaust gas outlet 16*a* can be cooled to reduce burden on an environment, and an energy efficiency of the water heater 1 can be improved with pro-heating the air flowing into the air supply pipe 14 through the air supply inlet 14*a*.

The water input pipe 20 is connected to an inlet 18*a* of the heat exchanger 18, and the heated water output pipe 22 is connected to an outlet 18*b* of the heat exchanger 18. A water inlet 20*a* communicated with the water supply source (not shown) such as a water service pipe is provided at an upstream-side end of the water input pipe 20. A heated water outlet 22*a* communicated with a heated water supplying location such as kitchen or bathroom (not shown) is provided at a downstream-side end of the heated water output pipe 22. Tap water flows into the water input pipe 20 through the water inlet 20*a*, flows from the water input pipe 20 to the heat exchanger 18, and is heated upon passing through the heat exchanger 18. Then the heated water heated by the heat exchanger 18 flows from the heat exchanger 18 to the heated water output pipe 22, and is sent out from the heated water output pipe 22 through the heated water outlet 22*a*.

The bypass pipe 24 connects the water input pipe 20 and the heated water output pipe 22 by bypassing the heat exchanger 18. The bypass pipe 24 is provided with a bypass servo valve 44 for adjusting an opening area of the bypass pipe 24. The bypass servo valve 44 adjusts the opening area of the bypass pipe 24 to adjust bypass ratio (ratio of a flow rate of water flowing into the heated water output pipe 22 from the water input pipe 20 through the bypass pipe 24 relative to a flow rate of water flowing into the heated water output pipe 22 from the water input pipe 20 through the heat exchanger 18).

A flow rate sensor 46 for detecting a flow rate of the water supplied to the water input pipe 20 (i.e., a flow rate of the heated water from the heated water output pipe 22), and a flow rate regulating valve 48 for adjusting the flow rate of the water supplied to the water input pipe 20 are provided in the water input pipe 20. The heated water output pipe 22 is provided with a canister temperature sensor 50 for detecting a temperature of the heated water in a vicinity of an outlet 18*b* of the heat exchanger 18, and a heated water output temperature sensor 52 for detecting a temperature of the heated water supplied from the heated water output pipe 22 to the heated water outlet 22*a*. The heat exchanger 18 is provided with two overheating prevention elements (a bimetal switch 54 and a temperature fuse 56).

The controller 26 is an electronic unit composed of microcomputer, volatile memory, non-volatile memory, and the like. Detection signals of the current sensor 12*a*, the high temperature thermocouple 35 (or the combustion flame thermistor 37), the flame rod 36, the air supply temperature sensor 40, the exhaust gas temperature sensor 42, the flow rate sensor 46, the canister temperature sensor 50, the heated water output temperature sensor 52, the bimetal switch 54, and the temperature fuse 56 are inputted to the controller 26. Further, the controller 26 controls operations of the fan 12, the gas source solenoid valve 28, the gas proportional valve 30, the gas switching solenoid valves 32*a*, 32*b*, 32*c*, the ignitor 38, the flow rate regulating valve 48, and the bypass servo valve 44.

The remote controller 4 is connected to the controller 26. The remote controller 4 is provided with a notification unit (not shown) for notifying a user of the water heater 1 with setting states and operation states of the water heater body 2, and an input unit (not shown) for receiving various input operations by the user of the water heater 1.

A heated water supplying operation performed by the water heater 1 will be described. When the water starts to be supplied to the heated water supplying location such as kitchen or bathroom, the water starts to be supplied from the water inlet 20*a* to the heated water outlet 22*a*. When the flow rate detected by the flow rate sensor 46 exceeds a predetermined starting flow rate of heating water, the controller 26 drives the fan 12 and opens the gas source solenoid valve 28 and the switchable gas solenoid valves 32*a*, 32*b*, 32*c* and causes the ignitor 38 to have the ignition plug 34 discharge electricity to ignite the burner 8. When the ignition of the burner 8 is confirmed by the flame rod 36, the controller 26 adjusts the combustion amount of the burner 8 by controlling speed of the fan 12, an opening area of the gas proportional valve 30, and opening and closing of the gas switching solenoid valves 32*a*, 32*b*, 32*c* so that the heated water supply temperature of the heated water output pipe 22 detected by the heated water output temperature sensor 52 comes to be at the heated water supply set temperature that is set in the remote controller 4. Further, the controller 26 limits the water supply amount to the water input pipe 20 by using the flow rate regulating valve 48 when the water supply amount to the water input pipe 20 is too much that heated water with the heated water supply set temperature cannot be supplied. Further, when the user intermittently uses the heated water, the controller 26 adjusts the bypass ratio by the bypass servo valve 44 so that fluctuation in the heated water supply temperature can be suppressed. When the flow rate detected by the flow rate sensor 46 decreases below a predetermined terminating flow rate of heating water, the controller 26 closes the gas source solenoid valve 28 and the gas switching solenoid valves 32*a*, 32*b*, 32*c* so that the burner 8 is extinguished and the fan 12 is stopped.

When the tap water supplied to the water input pipe 20 is hard water, scale builds up in the heat exchanger 18 accompanying continuous usages of the water heater 1. If the scale builds up inside the heat exchanger 18, water does not flow smoothly inside the heat exchanger 18, and water flow resistance increases. Further, when the scale builds up inside the heat exchanger 18, heat transmissivity of the heat exchanger 18 is degraded, and the combustion amount needed in the burner 8 to heat the water to the heated water supply set temperature increases. Due to this, when the scale builds up inside the heat exchanger 18, it is preferably to promptly notify the user of the situation to descale the inside of the heat exchanger 18. Thus, the water heater 1 of the present embodiment performs a scale buildup determination process shown in FIG. 3 while it performs the heated water supplying operation.

In step S2, the controller 26 sets an upper limit exhaust gas temperature according to the combustion amount of the burner 8. The upper limit exhaust gas temperature is set at a higher temperature than an exhaust gas temperature for a case where no scale is built up inside the heat exchanger 18. For example, the upper limit exhaust gas temperature is set at a temperature that added a predetermined temperature margin (for example, 20° C.) to the exhaust gas temperature for the case where no scale is built up inside the heat exchanger 18. The exhaust gas temperature for the case where no scale is built up inside the heat exchanger 18 can be identified from the combustion amount of the burner 8. The combustion amount of the burner 8 can be identified from the opening area of the gas proportional valve 30 and opening and closing states of the respective gas switching solenoid valves 32*a*, 32*b*, 32*c*. Due to this, for example, the controller 26 can calculate the upper limit exhaust gas temperature using a function that uses the opening area of the gas proportional valve 30 and the opening and closing states of the respective gas switching solenoid valves 32*a*, 32*b*, 32*c* as its parameters. The process proceeds to step S4 after step S2.

Figure 3:
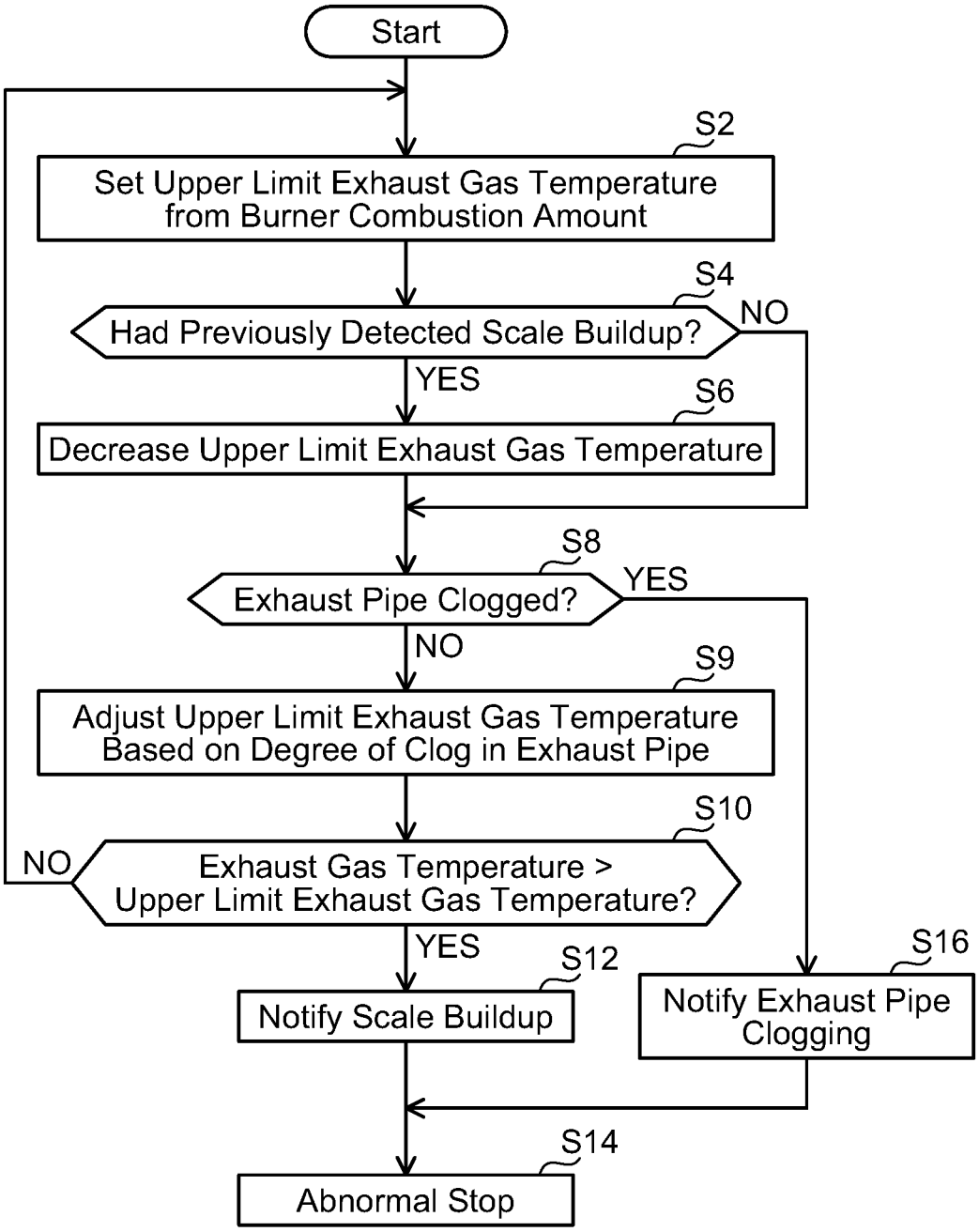
FIG. 3 is a flow chart of scale buildup determination process in the water heater 1 of the embodiment.

In step S4, the controller 26 determines whether or not scale buildup had previously been detected in the past. In the present embodiment, the controller 26 stores the determination result in the non-volatile memory each time the scale buildup determination process of FIG. 3 is performed. Due to this, the controller 26 can determine whether or not the scale buildup had previously been detected in the past from the history of the determination results of the scale buildup determination process stored in the non-volatile memory. The process proceeds to step S6 in a case where the scale buildup had previously been detected in the past (in case of YES in step S4).

In step S6, the controller 26 reduces the upper limit exhaust gas temperature that was set in step S2 for example by a predetermined temperature margin (e.g., 10° C.). The process proceeds to step S8 after step S6.

In step S8, the controller 26 determines whether or not the exhaust pipe 16 is clogged. In the present embodiment, the controller 26 determines that the exhaust pipe 16 is clogged if the degree of clog in the exhaust pipe 16 is extremely high and the process to resolve the clog in the exhaust pipe 16 is necessary.

The degree of clog in the exhaust pipe 16 can be detected by various methods. For example, when the degree of clog in the exhaust pipe 16 increases, the fan 12 is more likely to run idle as compared to a case where the degree of clog in the exhaust pipe 16 is low, so the driving current for the fan 12 required in rotating the fan 12 at a same fan speed as the latter case drops. Thus, the controller 26 can detect the degree of clog in the exhaust pipe 16 according to the fan speed of the fan 12 and a current value detected by the current sensor 12*a*.

Further, when the degree of clog in the exhaust pipe 16 increases, a state of the flame in the burner 8 changes as compared to the case where the degree of clog in the exhaust pipe 16 is low. For example, as shown in FIG. 1, if the burner 8 is the all-primary air burner the flame of the burner 8 becomes shorter when the degree of clog in the exhaust pipe 16 increases as compared to the case where the degree of clog in the exhaust pipe 16 is low. Due to this, when the degree of clog in the exhaust pipe 16 becomes high, the detection signal in the high temperature thermocouple 35 increases as compared to the case where the degree of clog in the exhaust pipe 16 is low. Thus, the controller 26 can detect the degree of clog in the exhaust pipe 16 based on the detection signal of the high temperature thermocouple 35. Alternatively, as shown in FIG. 2, if the burner 8 is the Bunsen burner, the flame of the burner 8 becomes longer when the degree of clog in the exhaust pipe 16 increases as compared to the case where the degree of clog in the exhaust pipe 16 is low. Due to this, when the degree of clog in the exhaust pipe 16 becomes high, the detection signal in the combustion flame thermistor 37 increases as compared to the case where the degree of clog in the exhaust pipe 16 is low. Thus, the controller 26 can detect the degree of clog in the exhaust pipe 16 based on the detection signal of the combustion flame thermistor 37.

The clog determination of the exhaust pipe 16 in step S8 of FIG. 3 can be performed by one of the aforementioned methods. In a case where the degree of clog in the exhaust pipe 16 is extremely high and the determination is made that the exhaust pipe 16 is clogged (in case of YES in step S8), the process proceeds to step S16. In step S16, the controller 26 notifies the user that the exhaust pipe 16 is clogged by using the remote controller 4. After step S16, the process proceeds to step S14. In step S14, the controller 26 terminates the water heater 1 in abnormal stop. After this, when the treatment for resolving the clog in the exhaust pipe 16 is performed by the user, and a clog resolving treatment completion is inputted by using the remote controller 4, the controller 26 returns the water heater 1 to its normal state.

In a case where a determination is made that the exhaust pipe 16 is not clogged (in case of NO in step S8), the process proceeds to step S9. In step S9, the controller 26 adjusts the upper limit exhaust gas temperature according to the degree of clog in the exhaust pipe 16. If the degree of clog in the exhaust pipe 16 is high, the exhaust gas temperature becomes higher as compared to the case where the degree of clog in the exhaust pipe 16 is low. Due to this, when the scale buildup is to be determined from the exhaust gas temperature, an influence of the degree of clog in the exhaust pipe 16 on the exhaust gas temperature needs to be removed. For example, the controller 26 may adjust the upper limit exhaust gas temperature by multiplying a coefficient corresponding to the degree of clog in the exhaust pipe 16 (for example, a coefficient in a range of 0.9 to 1.1, with a greater coefficient value for a greater degree of clog in the exhaust pipe 16) to the upper limit exhaust gas temperature. The process proceeds to step S10 after step S9.

In step S10, the controller 26 determines whether or not the exhaust gas temperature detected by the exhaust gas temperature sensor 42 exceeds the upper limit exhaust gas temperature. In a case where the exhaust gas temperature is equal to or less than the upper limit exhaust gas temperature (in case of NO in step 10), the process returns to step S2. If the exhaust gas temperature exceeds the upper limit exhaust gas temperature (in case of YES in S10), the process proceeds to step S12.

In step S12, the controller 26 notifies the user that the scale has built up in the heat exchanger 18 by using the remote controller 4. After step S12, the process proceeds to step S14. In step S14, the controller 26 terminates the water heater 1 in abnormal stop. After this, when the treatment for descaling in the heat exchanger 18 is performed by the user, and a descaling treatment completion is inputted by using the remote controller 4, the controller 26 returns the water heater 1 to its normal state.

As above, the water heater 1 of the present embodiment is a combustion type water heater that heats the water by burning the fuel gas. The water heater 1 comprises the burner 8 configured to generate the combustion gas by burning the fuel gas; the heat exchanger 18 configured to exchange heat between the water passing through on the inside of the heat exchanger 18 and the combustion gas flowing on the outside of the heat exchanger 18; the exhaust pipe 16 configured to discharge the combustion gas after the heat exchange in the heat exchanger 18 as the exhaust gas; the exhaust gas temperature sensor 42 configured to detect the temperature of the exhaust gas flowing in the exhaust pipe 16 as the exhaust gas temperature; and the controller 26 configured to detect the degree of clog in the exhaust pipe 16 and configured to determine whether or not scale has built up inside the heat exchanger 18 based on the exhaust gas temperature and the degree of clog in the exhaust pipe 16 (being an example of a clog degree detector and a scale buildup determiner).

Since the heat transmissivity of the heat exchanger 18 is degraded when the scale builds up inside the heat exchanger 18, so the exhaust gas temperature thereby rises. Thus, in the water heater 1 of the present embodiment, the determination on whether or not the scale is built up inside the heat exchanger 18 is performed based on the exhaust gas temperature. Notably, the exhaust gas temperature rises not only when the scale has built up inside the heat exchanger 18, but also by progression of the clogging in the exhaust pipe 16. Due to this, in the case of performing the scale buildup determination based on the exhaust gas temperature, the influence in the rise of the exhaust gas temperature that accompanies the progression of the clogging in the exhaust pipe 16 needs to be removed. To do so, the water heater 1 of the present embodiment determines whether or not the scale has built up inside the heat exchanger 18 based on the exhaust gas temperature and the degree of clog in the exhaust pipe 16. The detection of the degree of clog in the exhaust pipe 16 can be performed by using sensor or the like with which a combustion type water heater would normally be provided, without using a dedicated sensor. According to the water heater 1 of the present embodiment, the scale buildup inside the heat exchanger 18 can be detected without using a dedicated sensor such as a fouling sensor.

The water heater 1 of the present embodiment has the controller 26 (being an example of the scale buildup determiner) configured to determine that the scale is built up inside the heat exchanger 18 when the exhaust gas temperature exceeds the upper limit exhaust gas temperature (see step S10 of FIG. 3), and the upper limit exhaust gas temperature is set lower for the case where the degree of clog in the exhaust pipe 16 is high as compared to the case where the degree of clog in the exhaust pipe 16 is low (see step S9 of FIG. 3).

According to the above water heater 1, the determination on whether or not the scale is built up inside the heat exchanger 18 can accurately be made without being influenced by the rise in the exhaust gas temperature accompanying the progression of clogging in the exhaust pipe 16.

The water heater 1 of the present embodiment is configured so that the upper limit exhaust gas temperature is set according to the combustion amount of the burner 8 (see step S2 of FIG. 3).

When the combustion amount of the burner 8 changes, the exhaust gas temperature changes in accordance therewith. In the water heater 1 of the present embodiment, the upper limit exhaust gas temperature is set according to the combustion amount of the burner 8, thus the determination on whether or not the scale is built up inside the heat exchanger 18 can more accurately be made.

In the water heater 1 of the present embodiment, the controller 26 comprises the non-volatile memory (being an example of a memory) storing the history of the determination results of the controller 26 (being an example of the scale buildup determiner), and the upper limit exhaust gas temperature is configured to be set lower for the case where the scale buildup inside the heat exchanger 18 had previously been detected in the past than for the case where no scale buildup has been detected inside the heat exchanger 18 in the past (see steps S4 and S6 of FIG. 3).

The quality of the water supplied to the water heater 1 differs depending on a region where the water heater 1 is used. If the water heater 1 is to be used in a region where water with which the scale easily builds up is supplied, it is preferable to promptly detect the scale buildup and promptly perform descaling. In the water heater 1 of the present embodiment, when the scale buildup inside the heat exchanger 18 had previously been detected in the past, the upper limit exhaust gas temperature for the scale buildup determination taking place thereafter is set low so that the scale buildup becomes more prone to being detected. By configuring as above, the scale buildup can promptly be detected and the descaling can promptly be performed for cases where the water heater 1 is to be used in the region where water with which the scale easily builds up is supplied.

The water heater 1 of the present embodiment further comprises the air supply pipe 14 configured to supply the air to the burner 8, the fan 12 configured to send the air from the air supply pipe 14 to the burner 8 and send the exhaust gas to the exhaust pipe 16, and the current sensor 12*a* configured to detect the driving current of the fan 12, and the controller 26 (being an example of the clog degree detector) is configured to detect the degree of clog in the exhaust pipe 16 based on the driving current of the fan 12.

When the degree of clog in the exhaust pipe 16 is high, the fan 12 is more likely to run idle as compared to the case where the degree of clog in the exhaust pipe 16 is low, so the driving current for the fan 12 drops. Thus, as above, the degree of clog in the exhaust pipe 16 can be detected without using a dedicated sensor by detecting the degree of clog in the exhaust pipe 16 based on the driving current of the fan 12.

Alternatively, in a case where the burner 8 is the all-primary air burner, the water heater 1 of the present embodiment further comprises the high temperature thermocouple 35 arranged in a vicinity of the burner 8, and the controller 26 (being an example of the clog degree detector) is configured to detect the degree of clog in the exhaust pipe 16 based on the detection signal of the high temperature thermocouple 35.

When the burner 8 is the all-primary air burner, the flame of the burner 8 becomes shorter when the degree of clog in the exhaust pipe 16 is high as compared to the case where the degree of clog in the exhaust pipe 16 is low, and the detection signal of the high temperature thermocouple 35 arranged in a vicinity of the burner 8 increases. As above, the degree of clog in the exhaust pipe 16 can be detected based on the detection signal of the high temperature thermocouple 35 without using a dedicated sensor.

Alternatively, in a case where the burner 8 is the Bunsen burner, the water heater 1 of the present embodiment further comprises the combustion flame thermistor 37 arranged apart from the burner port of the burner 8 by the predetermined distance, and the controller 26 (being an example of the clog degree detector) is configured to detect the degree of clog in the exhaust pipe 16 based on the detection signal of the combustion flame thermistor 37.

When the burner 8 is the Bunsen burner, the flame of the burner 8 becomes longer when the degree of clog in the exhaust pipe 16 is high as compared to the case where the degree of clog in the exhaust pipe 16 is low, and the detection signal of the combustion flame thermistor 37 arranged apart from the burner port of the burner 8 by the predetermined distance increases. As above, the degree of clog in the exhaust pipe 16 can be detected based on the detection signal of the combustion flame thermistor 37 without using a dedicated sensor.

Specific embodiments have been described in detail, however, these are mere exemplary indications and thus do not limit the scope of the claims. The art described in the claims includes modifications and variations of the specific examples presented above.

Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

The invention claimed is:

1. A combustion type water heater configured to heat water by burning fuel, the water heater comprising:

a burner configured to generate combustion gas by burning the fuel;

a heat exchanger configured to exchange heat between the water passing through on an inside of the heat exchanger and the combustion gas flowing on an outside of the heat exchanger;

an exhaust pipe configured to discharge the combustion gas after the heat exchange in the heat exchanger as exhaust gas;

an exhaust gas temperature detector configured to detect a temperature of the exhaust gas flowing in the exhaust pipe as an exhaust gas temperature;

a clog degree detector configured to detect a degree of clog in the exhaust pipe; and a scale buildup determiner configured to determine whether or not scale has built up inside the heat exchanger based on the exhaust gas temperature and the degree of clog in the exhaust pipe.

2. The combustion type water heater according to claim 1, wherein the scale buildup determiner is configured to determine that scale has built up inside the heat exchanger when the exhaust gas temperature exceeds an upper limit exhaust gas temperature, and the upper limit exhaust gas temperature is set lower for a case where the degree of clog in the exhaust pipe is high than for a case where the degree of clog in the exhaust pipe is low.

3. The combustion type water heater according to claim 2, wherein the upper limit exhaust gas temperature is set according to a combustion amount of the burner.

4. The combustion type water heater according to claim 2, further comprising:

a memory configured to store determination result history of the scale buildup determiner, wherein the upper limit exhaust gas temperature is set lower for a case where the scale buildup inside the heat exchanger had previously been detected than for a case where the scale buildup inside the heat exchanger has never been detected.

5. The combustion type water heater according to claim 1, further comprising:

an air supply pipe configured to supply air to the burner, a fan configured to send the air from the air supply pipe to the burner and send the exhaust gas to the exhaust pipe; and a current detector configured to detect driving current of the fan, wherein the clog degree detector detects the degree of clog in the exhaust pipe based on the driving current of the fan.

6. The combustion type water heater according to claim 1, further comprising:

a high temperature thermocouple arranged in a vicinity of the burner, wherein the burner is an all-primary air burner, and the clog degree detector detects the degree of clog in the exhaust pipe based on a detection signal of the high temperature thermocouple.

7. The combustion type water heater according to claim 1, further comprising:

a combustion flame thermistor arranged apart from a burner port of the burner by a predetermined distance, wherein the burner is a Bunsen burner, and the clog degree detector detects the degree of clog in the exhaust pipe based on a detection signal of the combustion flame thermistor.

* * * * *